US005257638A

United States Patent [19]

Alvemarker

[11] Patent Number: 5,257,638

[45] Date of Patent: Nov. 2, 1993

[54] DISH WASHING MACHINE WITH A VERTICALLY MOVABLE DOOR BLADE

[76] Inventor: Arne Alvemarker, Malaregarden 3, S-240 21 Löddeköpinge, Sweden

[21] Appl. No.: 848,945

[22] PCT Filed: Oct. 16, 1990

[86] PCT No.: PCT/SE90/00661

§ 371 Date: Jun. 10, 1992

§ 102(e) Date: Jun. 10, 1992

[87] PCT Pub. No.: WO91/05506

PCT Pub. Date: May 2, 1991

[30] Foreign Application Priority Data

Oct. 17, 1989 [SE] Sweden ..... 8903408

[51] Int. Cl.[5] ..... A47L 15/42

[52] U.S. Cl. ..... 134/200; 134/201; 220/331; 312/328

[58] Field of Search ..... 134/200, 115 R, 201; 312/272.5, 276, 328; 220/331, 333

[56] References Cited

U.S. PATENT DOCUMENTS 2,288,482 6/1942 Plohberger ..... 312/272.5 X
2,290,116 7/1942 Morner ..... 312/272.5 X
3,049,391 8/1962 Meeker et al. ..... 312/272
3,075,819 1/1963 Liegeon et al. ..... 312/271
3,279,874 10/1966 Noren et al. ..... 134/200 X
4,811,997 3/1989 Suyama et al. ..... 312/228

FOREIGN PATENT DOCUMENTS 76923 9/1988 Finland .

*Primary Examiner*—Philip R. Coe
*Attorney, Agent, or Firm*—Young & Thompson

[57] ABSTRACT

A dishwashing machine having a vertically movable door which when closed seals against the frame sides of a door opening leading to a treatment chamber (10) in which dishes are washed by spraying the dishes with washing liquid. The door opening includes a bottom, substantially vertical part (28) located on the front side of the chamber, and a top part (30) which extends obliquely upwards and in towards the machine interior. The door comprises a bottom and a top section (22, 20) and a center section (24), which are pivotally connected to one another. The sections are supported and guided by pivot arms (38) and link arms (42) in a manner such that when pulling up the door from its closed position, the top section will swing into the machine to a position adjacent the rear wall (14) of the chamber.

4 Claims, 2 Drawing Sheets

DISH WASHING MACHINE WITH A VERTICALLY MOVABLE DOOR BLADE

The invention relates a dishwashing machine provided with a vertically movable door which when closed seals against the side of a doorframe mounted in a door opening which leads to a treatment chamber in which dishes are washed, by spraying the dishes with washing liquid.

The object of the invention is to provide an arrangement by means of which the door can be opened and closed in a manner such that when the door is open and exposes said door opening, the door will not lie externally of the front side of the machine or the upper side thereof or require flaps to be lowered and raised, as is the case with a number of known dishwashing machines. The need for such an arrangement is particularly pronounced in smaller or older restaurant kitchens, where space is often at a minimum.

Such an arrangement is achieved in accordance with the invention by means of the characteristic features set forth in the following Claims.

Furthermore, because the upper part of the door opening slopes inwards, the advantage is afforded that the treatment chamber is accessible from above and downwards, so as to facilitate handling of dishes when placing dishes into the machine and removing dishes therefrom.

BRIEF DESCRIPTION OF THE DRAWING

A suitable embodiment of the inventive arrangement is illustrated in the accompanying drawings.

DETAILED DESCRIPTION OF THE INVENTION

Figure 1:
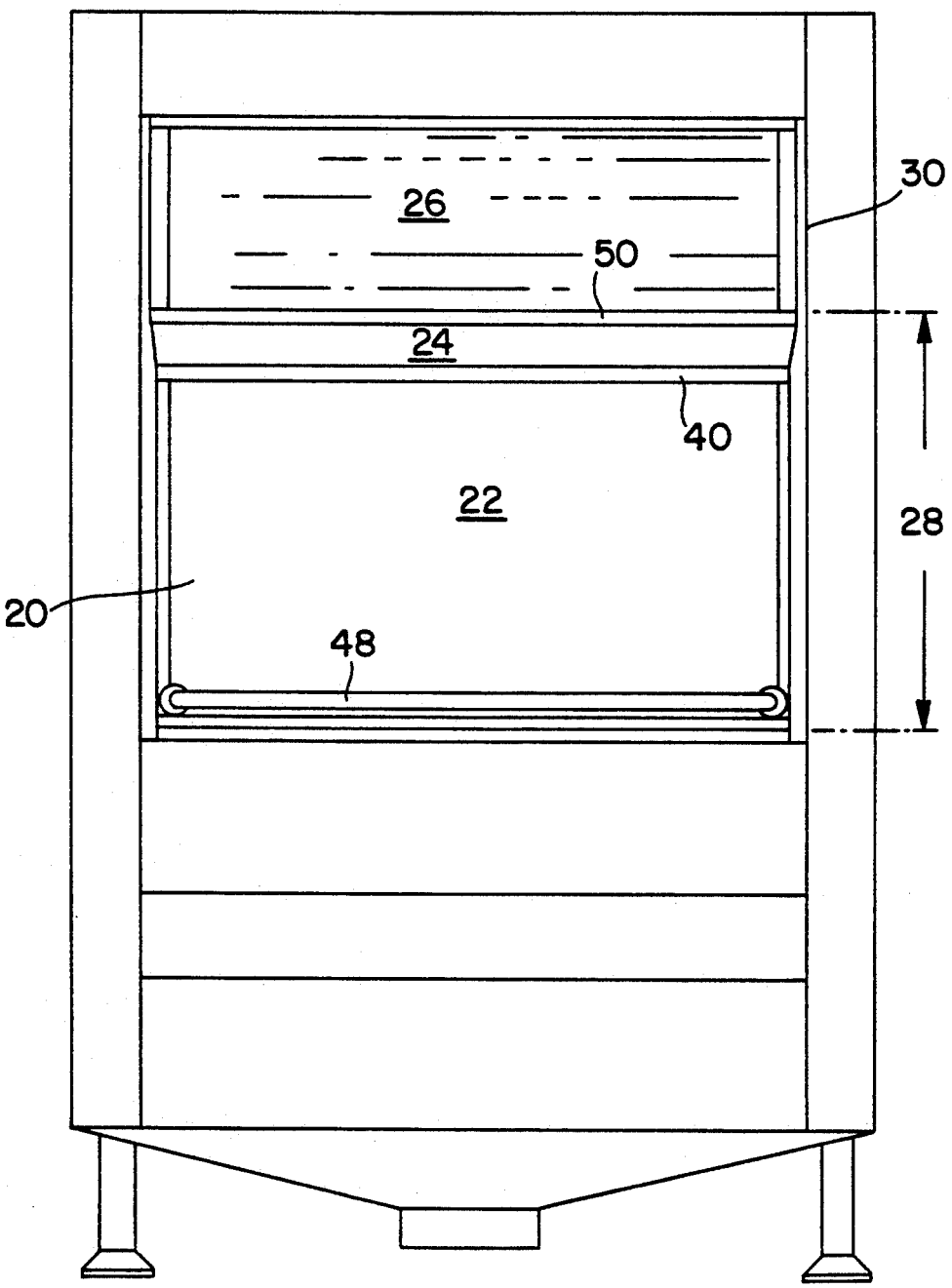
FIG. 1 is a front view of a dishwashing machine constructed in accordance with the invention and having a door hinged for vertical movement.
Figure 2:
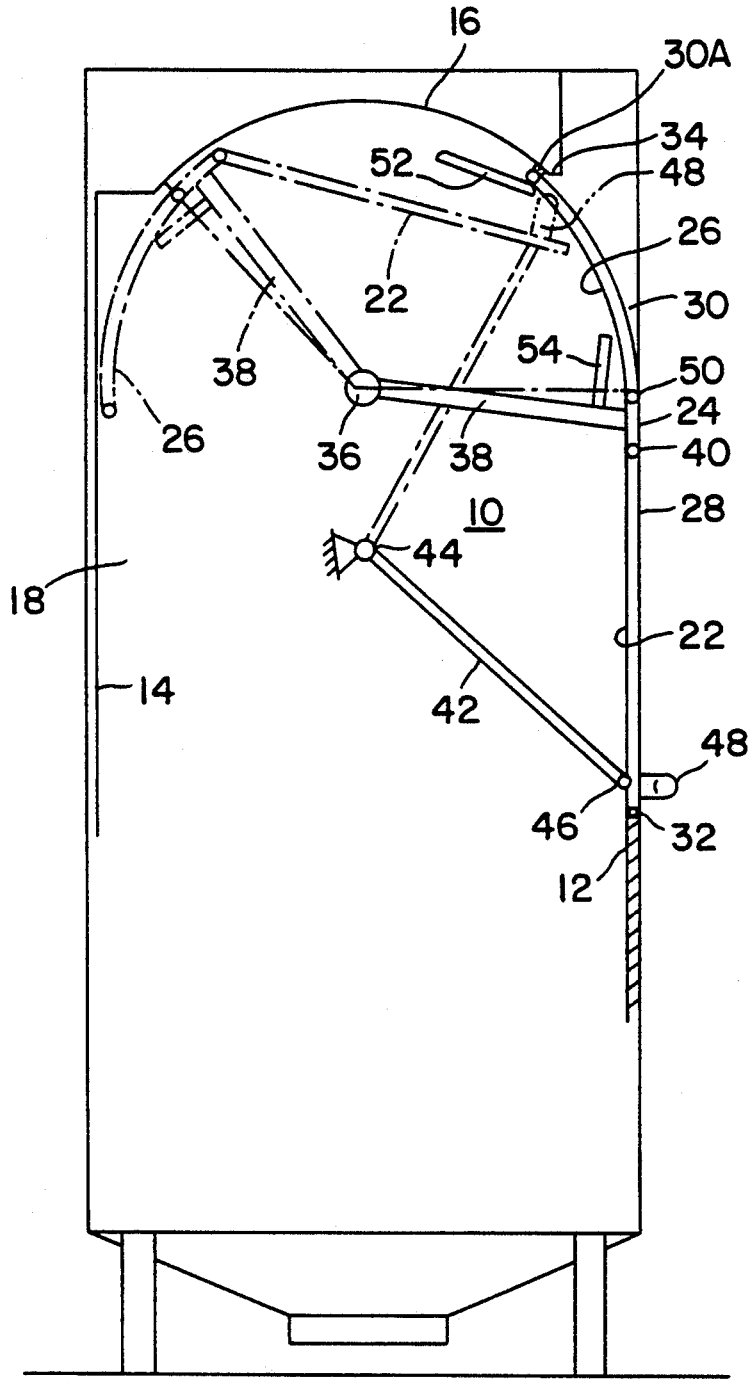
FIG. 2 is a vertical sectional view of the machine and illustrates the hinged door schematically.

The dishwashing machine has a treatment chamber 10 and dish-supporting trays or baskets (not shown) and spray nozzles (not shown) through which the dishes are sprayed. The chamber has a front wall 12, a rear wall 14, a top wall 16 and side walls 18.

A door 20 comprises a bottom section 22, a centre section 24 and a top section 26.

The door opening is defined by a bottom part 28 in which the bottom door section 22 and the centre door section 24 sealingly fit, and a top part 30 whose frame sides extend obliquely upwards and in towards the machine interior. In the illustrated example, the top door section 26 is arched and consequently the top part of the door opening will have correspondingly arched frame sides.

The door also seals against the bottom edge 32 and the top edge 34 of the door opening when the door is closed.

Sealing is achieved by pressing the bottom section 22 in a direction from within and outwards, as is also the case with the centre section 24, whereas the top section 30 is pressed inwardly from the outside, in a manner described herebelow.

These relatively small movements that occur immediately before closing the door result in sealing coaction between conical sealing strips disposed along the edges of the door and the edges of the door opening.

Mounted approximately midway between the front and back walls 12, 14 of the frame is a horizontal pivot shaft 36 intended for the pivot pins of two pivot arms 38, the outer ends of which are connected with the centre section 24 and have a slightly obliquely and downwardly extending position when the door is closed. When raising the centre section and the bottom section, these sections will thus be moved from their sealing position through a radially outward movement at the same time as the sections are swung up.

The bottom section 22 is connected to the centre section 24 by means of a hinge joint 40.

Two linkage arms 42 are pivotally mounted on a pivot shaft 44 located beneath the pivot shaft 36 and the outer ends of said arms are connected by means of a hinge joint 46 to the bottom section 22, preferably at the lower end part of said section, as illustrated, so as to obtain good stability.

The bottom section, and therewith the whole of the door, can be lifted with the aid of a handle 48 located at a comfortable lifting height.

The upper section 26 is connected to the centre section 24 by means of a hinge joint 50.

Two securely fixed guide cams 52 are provided for coacting with laterally directed pins 30A at the upper edge part of the top section immediately prior to the door being located in its closed position, such that the top section will be urged from within and outwardly so as to seal the closed door.

As will be seen from FIG. 1, the top section 26 and corresponding part 30 of the door opening is wider than the bottom section 22 and corresponding part of said door opening. The centre section also converges and forms wedge surfaces which pass into sealing abutment with corresponding converging side-edge parts of the door opening.

As will be seen from the Figures, the height or vertical extension of the centre section is relatively small in relation to the height or vertical extension of the other sections, in the illustrated embodiment less than one-fifth of the height of the bottom section.

As the pivot arms 38 are swung up to their horizontal position, the bottom section 22 and the centre section 24 are moved out from their sealing position. At the same time, the top section 26, with its pins 30A, slide on the cans 52 while being swung slightly inwards until the support pins 54 on the pivot arms 38 form supports for this end of the top section until the inner terminal position, shown in chain lines, is reached where the section 26 lies in the proximity of the rear wall 14.

In this inner terminal position, the bottom section 22 is located in the upper part of the chamber.

The door is balanced with the aid of spring devices (not shown), so that it can be lifted easily, the handle 48 being located in a readily accessible position beneath the upper edge 34 of the opening.

Modifications can be made within the scope of the invention as defined in the following main Claim. For instance, the centre section 24 and the top section 26 may form a rigid unit, although in this case the position of the rear wall 14 must be moved slightly rearwards in order to provide space for the section 26. The hinge joint 46 can be moved to a higher position on the bottom section. The path followed by the top section can be achieved with the aid of fixed guide paths for accommodating pins provided on said section.

As a result of the inventive arrangement, there is obtained a door which does not require additional space around the machine, as is required with "saloon"-type swing doors or downwardly swung flaps. The person using the machine can carry a cooking vessel or pastry dish in one hand and grip the handle with the other hand and open the door through a combined lifting and swinging movement, wherein said person leans over the upper, inwardly inclined opening part and places the vessel comfortably in position in a dish basket or removes a vessel therefrom.

I claim:

1. A dishwashing machine comprising a vertically movable door which when closed seals against frame sides of a door opening leading to a treatment chamber in which dishes are washed by spraying the dishes with washing liquid, said door opening including a bottom, substantially vertical part (28) which is located on a front side of the chamber (10), and a top part (30) which extends obliquely upwards and inwards into the machine; said door comprising at least one bottom and one top section (22, 26) which are pivotally connected together; said door being carried by a pair of pivot arms (38) which are pivotally mounted for rotation about a horizontal pivot axis (36) which lies substantially midway between front and rear walls (12, 14) of said chamber, said pivot arms having outer ends which are connected to the door via hinge joints (50 and 40 respectively) between the bottom and the top section; said bottom section being guided by a pair of link arms (42) which are pivotal about a horizontal axis (44) located beneath the pivot axis (36) of the pivot arms (38), said link arms having outer ends which are pivotally connected to the bottom section; and said top section being arranged such that upper and lower end edges of said top section follow an arcuate path which substantially coincides with an arcuate path of the hinge joints between the top and the bottom section from a closed, inwardly inclined position of the top section to an inner terminal position near the rear wall of the chamber.

2. A dishwashing machine according to claim 1, wherein the bottom section is pivotally connected with the top section through a center section (24).

3. A dishwashing machine according to claim 2, wherein the outer ends of the pivot arms (38) are attached to the center section (24).

4. A dishwashing machine according to claim 1, wherein the top section (26) is guided for movement along a substantially arcuate path which lies in the vicinity of a circular arcuate path described by the outer ends of the pivot arms (38); and wherein when in its closed position, the top section coacts with fixedly mounted cams (32) such that immediately prior to reaching said closed position, said top section is forced outwards into sealing engagement with the frame sides of the door opening and when being opened falls slightly inwards when the top section releases contact with the cams, whereafter a support (54) on the pivot arms forms stop means for the top section in said slightly inwardly located position.

* * * * *